US005429722A

United States Patent [19]

Cullen

[11] Patent Number: 5,429,722

[45] Date of Patent: Jul. 4, 1995

[54] MAGNESIUM ELECTROLYSIS CELL, LINING THEREFOR, AND METHOD

[75] Inventor: Robert M. Cullen, Bethel Park, Pa.

[73] Assignee: Indresco Inc., Dallas, Tex.

[21] Appl. No.: 350,751

[22] Filed: Dec. 7, 1994

Related U.S. Application Data

[63] Continuation of Ser. No. 167,505, Dec. 14, 1993, abandoned.

[51] Int. Cl.[6] ..... C25C 3/04

[52] U.S. Cl. ..... 204/70; 204/243 R; 204/279

[58] Field of Search ..... 204/70, 243 R, 279

[56] References Cited

U.S. PATENT DOCUMENTS 4,160,715 7/1979 Kinosz et al. ..... 204/243 R
4,411,305 10/1983 Beetle ..... 164/529

OTHER PUBLICATIONS

Kirk-Othmer Encyclopedia of Chemical Technology, Third Edition, vol. 14, FIGS. 1 and 2.

*Primary Examiner*—John Niebling
*Assistant Examiner*—Brendan Mee
*Attorney, Agent, or Firm*—John L. Sigalos

[57] ABSTRACT

A magnesium electrolysis cell having a refractory lining comprising at least one glass-ceramic shape, the lining itself, and the method of increasing the service life of the refractory lining of a magnesium electrolysis cell comprising using a plurality of glass-ceramic shapes to form the lining.

12 Claims, No Drawings

MAGNESIUM ELECTROLYSIS CELL, LINING THEREFOR, AND METHOD

This application is a continuation of application Ser. No. 08/167,505, filed Dec. 14, 1993, now abandoned.

BACKGROUND OF THE INVENTION

The present invention relates to magnesium electrolysis cells and linings therefor which give an increased service life.

Magnesium is the eighth most abundant element in the earth's crust and the third most abundant element in sea water. There are two principal commercial processes to obtain magnesium, thermal and electrolytic, with the electrolytic process accounting for the vast percentage of commercial production.

In the electrolytic process, sea water is utilized as the source of the magnesium, with the the Dow electrolytic process being a well known procedure. In such electrolytic processes an electrolysis cell is utilized and magnesium chloride concentrated from sea water is separated into magnesium metal and chlorine gas. It is conventional and necessary to use refractories in such cells, particularly to line the upper sidewalls of the magnesium electrolysis cells, in order to contain the salt bath and metal entrained in the bath and to prevent corrosion of the steel shell. The term "upper sidewalls" refers to the molten metal electrolyte melt line and above. Below this line, no refractory is used since the steel sides and bottom of the electrolytic cell act as cathodes for the electrolysis process. Steel is an acceptable material for containment of molten magnesium. However, at the melt line, and above, chlorine gas and hydrochloric acid vapors are concentrated and could corrode the steel very quickly and easily which is why refractories are used in the "upper sidewalls" of the electrolysis cell. The magnesium metal and the molten salt bath contained within the cell are very fluid and, hence, readily wet the surface of refractories and can easily penetrate into any cracks, fissures, or porosity in the lining. Further, magnesium metal is also very reducing and can attack many of the oxides contained in refractories. In addition, the alkali chlorides used to make up the electrolyte bath can attack certain components of the refractories, particularly the fine-grain bonding matrices. All of these conditions, along with the circulation of the electrolyte bath within the cell, lead to significant amounts of corrosion of the refractory lining.

Furthermore, above the electrolyte bath the refractories are exposed to a reducing atmosphere containing chlorine gas and hydrochloric acid vapors from the electrolysis of the magnesium chloride feed, and also carbon monoxide and carbon dioxide from the oxidation of the graphite anodes used in the cells. Lastly, there is superheated water vapor from the dehydration of the hydrous magnesium chloride feed. These gases also readily penetrate into any open porosity and attack certain components of the refractory and its bonding matrix.

A number of different types of refractory materials have been tried to give the best corrosion resistance. Early on, hard-burned, low porosity, and low permeability fire clay brick were utilized in magnesium electrolysis cells and although they contain less open porosity than typical refractories, they still were unsatisfactory due to the fact that they were penetrated by magnesium metal, alkali chlorides, and gases from the reducing atmosphere contained in the electrolysis cells. Further, the alkali chlorides would attack the bonding matrix forming expansive alkali phases and soluble chloride phases and cause the hot face of the refractory to become weak and friable. This lead to further penetration through the disrupted region and the circulation of the electrolytic bath caused corrosion of the hot face.

Sintered, high alumina compositions were also attempted to be utilized, but it was found that they reacted with the electrolyte bath in a similar fashion as the fire clay refractories noted above. Further, they had an inherently higher open porosity than fire clay brick which made them even less satisfactory.

Efforts to utilize other refractory materials such as sintered, alumina-chrome solid solution, high alumina compositions and sintered magnesia brick were also tried but each was also found to be unsatisfactory. In the case of the alumina-chrome solid solution bonded high alumina chrome compositions, penetration of the electrolyte bath caused extensive reorganization of the bonding matrix due to the fact that the magnesium metal reduced it to metallic aluminum and chromium and, thus, no alumina-chrome solid solution bond remained. Also, the magnesia present reacted with additional alumina from the bonding matrix to form an expansive spinel phase, which weakened the refractory shape and made it susceptible to spalling.

With respect to the sintered magnesia brick, the fine magnesia of the bonding matrix was attacked by the chlorides in the electrolysis bath which weakened the brick. In addition, superheated water vapor from the dehydration of hydrous magnesium chloride feed caused hydration of the magnesia, resulting in formation of an expansive brucite phase which further weakened the brick.

Fused cast refractories were also tried including alumina, magnesia, mullite, and chromite based compositions. Although these fused cast compositions did show some improvement over the sintered refractories previously used, they still did not provide the desired surface life due to reaction with components of the electrolytic bath.

However, it was found that fused cast magnesium aluminate spinel compositions increased the service life of the refractory linings of magnesium electrolysis cells and refractories made therefrom have performed well in the upper side walls of magnesium electrolysis cells. However, despite their improvement over the prior refractories discussed above, they are still not satisfactory. Because of the manner in which fused cast refractories are formed, many types of imperfections occur during the manufacture thereof. A large volume shrinkage occurs upon cooling and crystallization of the melt results in casting voids within the shade. Gases dissolved in the melt are released during crystallization which can result fine porosity in the final shape. Varied crystal sizes, texture and composition can result due to different cooling rates experienced by the shape as cools from the exterior surface to the center. Moreover, if the shapes are not properly cooled and, particularly, if cooled too quickly, the stresses generated during crystallization do not have time to be adequately relieved, resulting in either cracking or very fine cracks in the formed refractory shape.

In addition to the disadvantages of fused cast refractories related to the manufacturing process there are inherent shortcomings in the final products themselves. First, thermal conductivity of the fused cast refractories is almost double that of sintered refractories and the heat losses from furnace linings are very significant. Further, the thermal expansion is also very high. Therefore, expansion allowances and thermal shock due to temperature fluctuations in the cell have to be taken into consideration during furnace design. Moreover, because of the problems inherent in forming fused cast refractories, their production is limited to simple shapes and these shapes are not easily cut or drilled. Thus, the manufacturing cost for fused cast refractories is very high due to processing requirements such as high electrical energy cost of melting the raw materials, the mold costs, and, as noted, the labor intensive finishing operations that are necessary to form the shapes.

SUMMARY OF THE INVENTION

The present invention results in cells and linings that have improved performance and longer refractory lining service life.

Briefly stated, the present invention comprises a magnesium electrolysis cell having a refractory lining at least a portion of which comprises a glass-ceramic shape. The invention also comprises the lining itself for magnesium electrolysis cells comprising a plurality of glass-ceramic shapes.

The instant invention is also directed to a method of increasing the service life of the refractory lining of magnesium electrolysis cells comprising using a plurality of glass-ceramic shapes to form said lining.

DETAILED DESCRIPTION

The essence of the instant invention is the utilization of a glass-ceramic to form the entire lining or a portion of the lining of a magnesium electrolysis cell. It is preferred to use such a glass-ceramic to line the cell at least at the metal line and above.

Glass-ceramics are a class of materials that are produced by melting the appropriate glass-forming materials in a glass tank, forming the desired shape using standard glass-forming techniques, and subsequently heat treating the shapes to convert the glass to a polycrystalline ceramic. The resulting microstructure of glass-ceramics is characterized by very fine grained, randomly oriented crystals, surrounded by minor amounts of residual glassy phase with almost no voids, microcracks, or any open porosity present. This microstructure can result in several unique properties possible with glass-ceramics including translucency, high mechanical strength, machinability, along with very low and uniform thermal expansion characteristics.

The production of glass-ceramics is well known. It is a conventional process and does not form a part of the instant invention. Any procedure utilized to form the same can be utilized. Basically, the production of such glass-ceramics is very much like that of conventional glass with the major difference being that one or more nucleating agents are added to the starting batch composition of the glass-ceramic to promote crystal growth during subsequent heat treatment. With glass it is essential that crystallization be avoided and nucleating agents are not included in glass batch compositions.

While any glass-ceramic can be utilized it is preferred to use magnesia-based glass-ceramics and especially preferred to utilize a cordierite-based material since it is chemically compatible with components of the electrolyte bath contained in the magnesium electrolysis cell and possesses low thermal expansion. In addition, cordierite glass-ceramics have little to no porosity and have good hydration resistance.

One advantage of the glass-ceramic shapes as linings for magnesium electrolysis cells is that they can be easily formed into a wide variety of shapes using the vast variety of forming techniques used for glass, including spinning, pressing, blowing, rolling and casting. This enables the formation of a wide variety of different shapes such as brick, block, and the like, that may be needed in any particular magnesium electrolysis cell.

The process of forming the glass-ceramic shape is conventional. Thus, once the glass shape has been formed, it is cooled to its annealing temperature and, as any glass, held for a certain length of time in order to alleviate any residual stresses that may have accumulated during forming. After annealing has been completed, the glass is cooled to room temperature where any number of finishing steps, if required, can performed, such as cutting, drilling, and grinding. A further advantage of glass-ceramics is that at this point the shapes are transparent and can be inspected for any flaws and imperfections. If any flaws are found, such as cracks, voids, inclusions, striations, and the like, the shape can simply be crushed, ground, and fed back into the glass tank as part of an original batch for reprocessing. Further, the transparency of the glass-ceramic at this point makes visual inspection fast, easy and accurate to insure that there are no defects in the product.

After the product is found to be suitable, the final step in the production of glass-ceramics, as is conventional, is the crystallization of the glass, also referred to as "ceramming". This involves subjecting the glass to a carefully designed and controlled heat treatment process which results in the nucleation and growth of the desired crystalline phase(s) and microstructure. The conventional heat treatment process involves three steps: first heating the glass rapidly to a temperature of 50 to 100° C. above its annealing point where it is given sufficient time to form the desired crystalline nuclei; followed by heating the glass more slowly to a maximum temperature where the crystal nuclei are allowed to grow and form a fine grained, randomly oriented polycrystalline microstructure; and, finally, after the desired microstructure is formed, permitting the glass-ceramic to be cooled to room temperature. Of course, at this point, the glass-ceramic is no longer transparent and visual inspection of internal flaws is not possible.

Thus, it will be seen that a major advantage of glass-ceramic shapes as linings for electrolytic cells is not only their physical properties, namely little or no open porosity, near theoretical density, almost complete crystallization of the original glass, uniform thermal expansion in all directions and relatively small amounts of volume shrinkage, but also their ease of forming into variety of shapes by any glass-forming technique.

As previously noted, it is preferred to use a cordierite-based glass-ceramic. Such products are available, one in particular being "PYROCERAM 9606" made by Corning Inc. This is a product presently utilized in missile nose cones, antenna windows, and radomes, it is primarily a glass-ceramic made from magnesia, silica and alumina utilizing a titania nucleating agent. The chemical composition of the product is as follows:

| | Wt. % |
|---|---|
| Silica | 53.3 |
| Alumina | 19.1 |

-continued

| | Wt. % |
|---|---|
| Magnesia | 17.3 |
| Titania | 9.7 |
| Iron Oxide | 0.2 |
| Lime | 0.2 |
| Total | 99.8 |

Such glass-ceramic has present as mineralogical phases cordierite ($2MgO\ 2Al_2O_3 5SiO_2$), cristobalite ($SiO_2$), rutile ($TiO_2$) and magnesium aluminum titanate ($4MgO\ Al_2O_3 9TiO_2$) with cordierite being by far the main phase representing some 80% by weight of the phases present. Cristobalite is only about 10% by weight with the balance being minor amounts of rutile and magnesium alumina titanate. While PYROCERAM 9606 is the preferred cordierte-based glass-ceramic any other cordierite-based glass-ceramic can be utilized as well as other magnesia-based glass-ceramics having an equivalent lack of porosity.

The size and configuration of the glass-ceramic shapes used to form the lining will vary widely dependent upon the particular design of the electrolysis cell to be lined. Thus, the glass-ceramic can be formed into brick, block, slabs, and the like. Conventional phosphate-bonded spinel mortar can be used to bond the shapes.

The lining can be formed, and is preferably formed, entirely of the glass-ceramic shape or shapes of various design, but the glass-ceramic shapes may only be cost effective in the upper side walls.

The invention will be further described in connection with the following example which is set forth for purposes of illustration only.

EXAMPLE

Bars of PYROCERAM 9696 were formed measuring $5\frac{1}{2} \times \frac{1}{2} \times \frac{1}{2}$ inches.

A laboratory scale magnesium electrolysis cell was utilized and set to operate under actual operating conditions. A bar was partially submerged in the electrolyte bath and the cell operated under the usual operating temperatures of 690 to 720° C. The bar was placed in the upper sidewall position so as to be exposed both to the metal line and to the gases formed above the electrolyte bath. The bar was maintained in operation for one week and then removed for testing. After removal no apparent corrosion had occurred.

A second test was then run in the same laboratory scale unit, again under the same actual operating conditions as above, but for a period of three weeks. The sample bar again exhibited no evidence of corrosion. The lack of corrosion after a three week exposure was most encouraging based upon the operator's experience of other refractories under these same conditions.

The inventor believes that other low expansion glass-ceramics such as lithia alumina-silicates or lithia-containing synthetic cordierite compositions can be effective in this application and that they fall within the spirit of this invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A magnesium electrolysis cell having a refractory lining in contact with the electrolyte bath and the gases formed above the electrolyte bath comprising at least one glass-ceramic shape.

2. The cell of claim 1 wherein said glass-ceramic shade is magnesia-containing or cordierite-based.

3. The cell of claim 2 wherein a cordierite-based glass-ceramic is used having a chemical composition comprising, by weight, about 53% silica, 19% alumina, 17% magnesia and 10% titania.

4. The cell of claim 2 wherein said cordierite-based glass-ceramic shape contains the mineralogical phases cordierite, cristobalite, rutile, and magnesium aluminum titanate.

5. A lining for a magnesium electrolysis cell in contact with an electrolyte bath and gases formed above the electrolyte bath comprising a plurality of glass-ceramic shapes.

6. The lining of claim 5 wherein said glass-ceramic shape is magnesia or cordierite-based.

7. The lining of claim 6 wherein a cordierite-based glass-ceramic shape is used having a chemical composition comprising, by weight, about 53% silica, 19% alumina, 17% magnesia, and 10% titania.

8. The lining of claim 6 wherein said cordierite-based glass-ceramic shape contains the mineralogical phases cordierite, cristobalite, rutile, and magnesium aluminum titanate.

9. A method of increasing the service life of the refractory lining in contact With the electrolyte bath and the gases formed above the electrolyte bath of a magnesium electrolysis cell comprising using a plurality of glass-ceramic shapes to form said lining.

10. The method of claim 9 wherein said glass-ceramic shape is magnesia or cordierite-based.

11. The method of claim 10 wherein a cordierite-based glass-ceramic shape is used having a chemical composition comprising, by weight, about 53% silica, 19% alumina, 17% magnesia, and 10% titanate.

12. The method of claim 10 wherein said cordierite-based glass-ceramic shape contains the mineralogical phases cordierite, cristobalite, rutile, and magnesium aluminum titanate.

* * * * *